US008601618B2

(12) United States Patent
Benzo et al.

(10) Patent No.: US 8,601,618 B2
(45) **Date of Patent: *Dec. 10, 2013**

(54) ADJUSTABLE BED WITH SLIDING SUBFRAME FOR TORSO SUBSECTION

(75) Inventors: Eduardo Rene Benzo, Villa Celina (AR); Rodolfo W. Ferraresi, Cumming, GA (US); Mario Cesar Eleonori, Martinez (AR)

(73) Assignee: Bedlab, LLC, Cumming, GA (US)

( * ) Notice: Subject to any disclaimer, the term of this patent is extended or adjusted under 35 U.S.C. 154(b) by 394 days.

This patent is subject to a terminal disclaimer.

(21) Appl. No.: 12/992,149

(22) PCT Filed: Mar. 24, 2009

(86) PCT No.: PCT/US2009/038121

§ 371 (c)(1),
(2), (4) Date: Nov. 11, 2010

(87) PCT Pub. No.: WO2009/139961

PCT Pub. Date: Nov. 19, 2009

(65) Prior Publication Data

US 2011/0072585 A1 Mar. 31, 2011

Related U.S. Application Data

(63) Continuation of application No. 12/120,363, filed on May 14, 2008, now Pat. No. 7,559,102.

(51) Int. Cl.
*A47C 17/04* (2006.01)

(52) U.S. Cl.
USPC ..... 5/39; 5/37.1; 5/47; 5/927

(58) Field of Classification Search
USPC ..... 5/37.1, 47, 613, 617, 618, 18.1, 20, 39, 5/927; 297/354.13, 362.11
See application file for complete search history.

(56) References Cited

U.S. PATENT DOCUMENTS

| | | | |
|---|---|---|---|
| 984,879 | A | 2/1911 | Bartholome |
| 2,297,105 | A | 9/1942 | Laukhuff |
| 2,400,155 | A | 5/1946 | Letschert et al. |
| 2,587,068 | A | 2/1952 | Sanders |
| 2,651,785 | A | 9/1953 | Berner |
| 3,281,141 | A | 10/1966 | Smiley et al. |
| 3,477,071 | A | 11/1969 | Emerson |
| 3,593,350 | A | 7/1971 | Knight et al. |
| 3,821,821 | A | 7/1974 | Burst et al. |
| 3,875,598 | A | 4/1975 | Foster et al. |
| 3,895,403 | A | 7/1975 | Davis |
| 3,905,055 | A | 9/1975 | Blair |

(Continued)

FOREIGN PATENT DOCUMENTS

WO WO2008/003027 A2 1/2008

*Primary Examiner* — Robert G Santos
*Assistant Examiner* — Nicholas Polito
(74) *Attorney, Agent, or Firm* — Eric W. Cernyar, P.C.

(57) ABSTRACT

A sliding subframe (130) mounted to the derriere-supporting section (50) of an adjustable bed (10) is adapted to translate the rotational axis (110) of the torso-supporting section (40) of the bed (10) toward the head end (12) as the torso-supporting section (40) is raised to an inclined position (44), and back toward the foot end (14) as the torso-supporting section (40) is lowered to a level position (42). This mechanism reduces compression of the lumbo-sacral area of the patient during bed articulation.

21 Claims, 16 Drawing Sheets

(56) References Cited

U.S. PATENT DOCUMENTS

| | | | | | |
|---|---|---|---|---|---|
| 3,913,152 | A | * | 10/1975 | Quakenbush | 5/37.1 |
| 3,959,832 | A | | 6/1976 | Parsons | |
| 4,006,499 | A | | 2/1977 | Young | |
| 4,183,109 | A | | 1/1980 | Howell | |
| 4,425,673 | A | | 1/1984 | Werner | |
| 4,446,587 | A | | 5/1984 | Jump | |
| 4,536,903 | A | | 8/1985 | Parker | |
| 4,654,903 | A | | 4/1987 | Chubb et al. | |
| 4,685,159 | A | | 8/1987 | Oetiker | |
| 4,868,937 | A | | 9/1989 | Connoly | |
| 4,947,496 | A | | 8/1990 | Connoly | |
| 4,996,731 | A | | 3/1991 | Kruyt | |
| 5,023,967 | A | | 6/1991 | Ferrand | |
| 5,142,719 | A | | 9/1992 | Vrzalik | |
| 5,161,274 | A | | 11/1992 | Hayes et al. | |
| 5,438,723 | A | | 8/1995 | Carroll | |
| 5,500,964 | A | | 3/1996 | Bergersen | |
| 5,568,661 | A | | 10/1996 | Bathrick et al. | |
| 5,577,280 | A | | 11/1996 | Elliott | |
| 5,608,932 | A | | 3/1997 | Hasegawa | |
| 5,611,096 | A | | 3/1997 | Bartlett | |
| 5,640,730 | A | | 6/1997 | Godette | |
| 5,715,548 | A | | 2/1998 | Weismiller et al. | |
| 5,781,949 | A | | 7/1998 | Weismiller | |
| 5,790,997 | A | * | 8/1998 | Ruehl | 5/618 |
| 5,802,640 | A | | 9/1998 | Ferrand et al. | |
| 5,862,551 | A | | 1/1999 | Oguma et al. | |
| 6,006,379 | A | | 12/1999 | Hensley | |
| 6,088,853 | A | | 7/2000 | Jansen | |
| 6,101,647 | A | | 8/2000 | Stroud et al. | |
| 6,154,900 | A | | 12/2000 | Shaw | |
| 6,212,713 | B1 | | 4/2001 | Kuck et al. | |
| 6,216,295 | B1 | | 4/2001 | Pearson | |
| 6,289,536 | B1 | | 9/2001 | Betson | |
| 6,378,148 | B1 | | 4/2002 | Votel | |
| 6,499,162 | B1 | | 12/2002 | Lu | |
| 6,640,365 | B1 | | 11/2003 | Chang | |
| 6,658,680 | B2 | | 12/2003 | Osborne et al. | |
| 6,892,405 | B1 | | 5/2005 | Dimitrio | |
| 7,032,261 | B2 | | 4/2006 | Heimbrock | |
| 7,036,166 | B2 | | 5/2006 | Kramer et al. | |
| 7,441,291 | B2 | | 10/2008 | Hayes et al. | |
| 7,559,102 | B1 | * | 7/2009 | Benzo et al. | 5/618 |
| 7,849,539 | B2 | | 12/2010 | Hornbech et al. | |
| 2004/0148704 | A1 | | 8/2004 | Tekulve | |
| 2004/0250349 | A1 | | 12/2004 | Rene | |

* cited by examiner

ADJUSTABLE BED WITH SLIDING SUBFRAME FOR TORSO SUBSECTION

RELATED DISCLOSURES

This application claims is a national stage application of International patent application no. PCT/US2009/038121, filed Mar. 24, 2009. This application also claims priority to and herein incorporates by reference U.S. patent application Ser. No. 12/120,363 filed on May 14, 2008, and issued on Jul. 14, 2009, as U.S. Pat. No. 7,559,102, entitled "Adjustable Bed with Sliding Subframe for Torso Section."

FIELD OF THE INVENTION

This invention relates generally to specialized beds and surfaces, and more particularly, to adjustable and articulating hospital beds.

BACKGROUND OF THE INVENTION

Normally in adjustable specialty beds, when the torso is elevated more than 30 degrees, the lower portion of the torso surface compresses the lumbo-sacral area and induces the patient to slide toward the foot-end area of the bed. This not only causes discomfort, but also increases the risks of shear-lesion and pressure ulceration.

Accordingly, there is a need for a mechanism that minimizes compression of the lumbo-sacral area during articulation of the torso surface toward an inclined position.

SUMMARY OF THE INVENTION

An axis displacement mechanism is provided that translates the rotational axis of the torso-supporting section of a multi-sectioned articulating specialty bed toward the head end as the torso-supporting section is raised to an inclined position. This mechanism may be incorporated into a large variety of adjustable beds.

In the preferred form, the axis displacement mechanism comprises two sliding telescopic mechanisms on opposite lateral sides of the bed. The outer portions of the telescopic mechanism, which act as guides, are bound to the bed's chassis. The inner bars of the telescopic mechanism are rotatably connected to the torso-supporting section of the bed.

In one embodiment, the axis displacement mechanism is actuated by a traction cable system. A steel cable is affixed at its ends to the bed's chassis. The cable is mounted on pulleys placed on selected points of the axis displacement mechanism and on the structure of the torso-supporting section, defining a circuit. When the torso surface is elevated, it forces traction of the flexible steel cable, forcing the inner bars of the telescopic mechanisms into extension, which in turn translates the torso rotational axis in the head-end direction. One or more traction springs bias the axis displacement mechanism toward the retracted position, so that the torso rotational axis will translate back to its original position as the torso surface is lowered. By regulating the length and amount of slack in the cable, one can preset an initiation angle at which the torso rotational axis begins to be forced backed. In this embodiment, the relative position of the torso rotational axis is a function of the elevation angle of the torso surface.

In another embodiment, one or more electric or hydraulic actuators are provided to act on the sliding telescopic mechanisms. In such an embodiment, the actuator regulates the extension and retraction of the torso rotational axis independently of the elevation angle of the torso surface.

It is the inventors' intent that the scope of any of the claims be defined by the language of the claims, and not narrowed by reference to the preferred embodiments described in this summary or in the detailed description of the invention.

DETAILED DESCRIPTION

Figure 1:
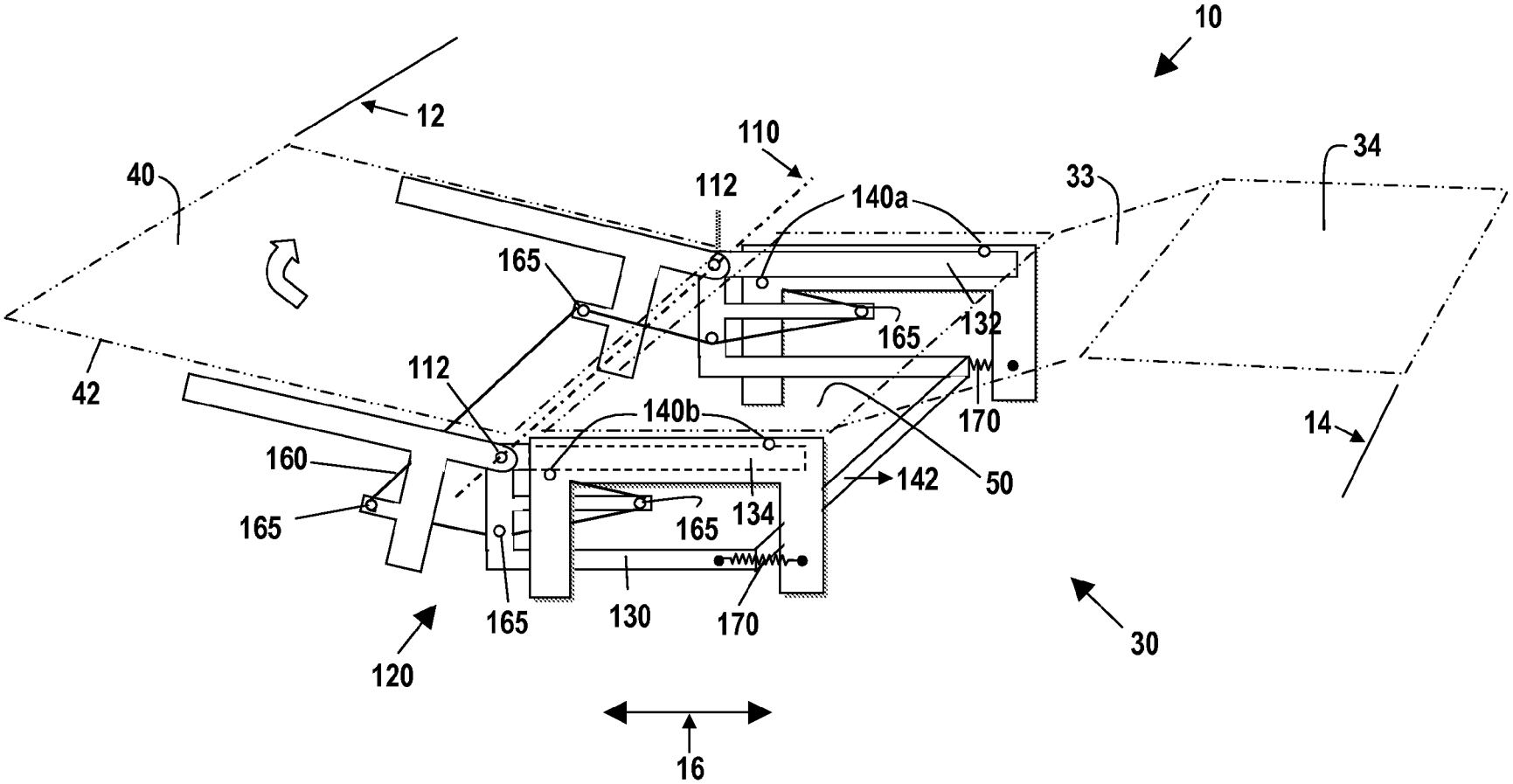
FIG. 1 illustrates one embodiment of a simple adjustable bed having a traction-wire-based sliding torso section subframe in a retracted position.

In describing preferred and alternate embodiments of the technology described herein, as illustrated in FIGS. 1-16, specific terminology is employed for the sake of clarity. The technology described herein, however, is not intended to be limited to the specific terminology so selected, and it is to be understood that each specific element includes all technical equivalents that operate in a similar manner to accomplish similar functions.

FIGS. 1-16 illustrate perspective views of different embodiments of an adjustable, articulatable bed 10 that extends along a longitudinal dimension 16 between a head end 12 and a foot end 14. To more fully illustrate the axis-displacement mechanism 120 of the bed 10, the patient support surface, head board, side board, and other aspects of the bed 10 are not shown in FIGS. 1-13.

The adjustable bed 10 comprises an articulatable, multi-sectioned patient support structure 30. The patient support structure 30 includes an articulating torso-supporting section 40, a derriere-supporting section 50, and preferably also an articulating upper-leg support structure 33 and an articulating lower-leg supporting structure 34. The derriere-supporting section 50 may also articulate, but for simplicity, FIGS. 1-16 depict embodiments with a derriere-supporting section 50 designed for rigid attachment to the main bed frame (not shown). Also for simplicity, FIGS. 7-12 and 15-16 depict only the torso and derriere-supporting sections 40 and 50 of the patient support structure 30.

To reduce compression of the lumbo-sacral area during articulation, the lower portion of the torso-supporting section 40 slides back as the torso-supporting section 40 is articulated toward an inclined position. The torso-supporting section 40 rotates about a transversal axis of rotation 110. As the torso-supporting section 40 rotates from a level (FIGS. 7, 13) or substantially level position 42 (e.g., FIG. 1) to an inclined position 44 (e.g., FIGS. 2, 3), an axis-displacement mechanism 120 causes the transversal axis of rotation 110 to slide back, along the bed's longitudinal dimension 16, toward the bed's head end 12. As the torso-supporting section 40 rotates from an inclined position 44 to a level position 42, the axis-displacement mechanism 120 causes the transversal axis of rotation 110 to slide forward, toward the bed's foot end 14.

The axis-displacement mechanism 120 comprises a sliding subframe 130 mounted on a guide mechanism 140*a*, 140*b*. The sliding subframe 130 comprises two parallel sliding arms or bars 132, 134 supporting and rotatably joined to the torso-supporting section 40 via hinges 112, which define the transversal axis of rotation 110. The guide mechanism, which is mounted on or adjacent to the derriere-supporting section 50, comprises two guides 140*a*, 140*b* positioned on opposite lateral sides of the derriere-supporting section 50. These guides 140*a* and 140*b* are adapted to guide the sliding arms or bars 132, 134 of the sliding subframe 130 between a retracted position 142 and an extended position 144 along the bed's longitudinal dimension 16, thereby translating the transversal axis of rotation 110 along the longitudinal dimension 16. The fully retracted and fully extended positions 142 and 144 of the sliding subframe 130 define opposite limits of translation of the transversal axis of rotation 110.

Figure 2:
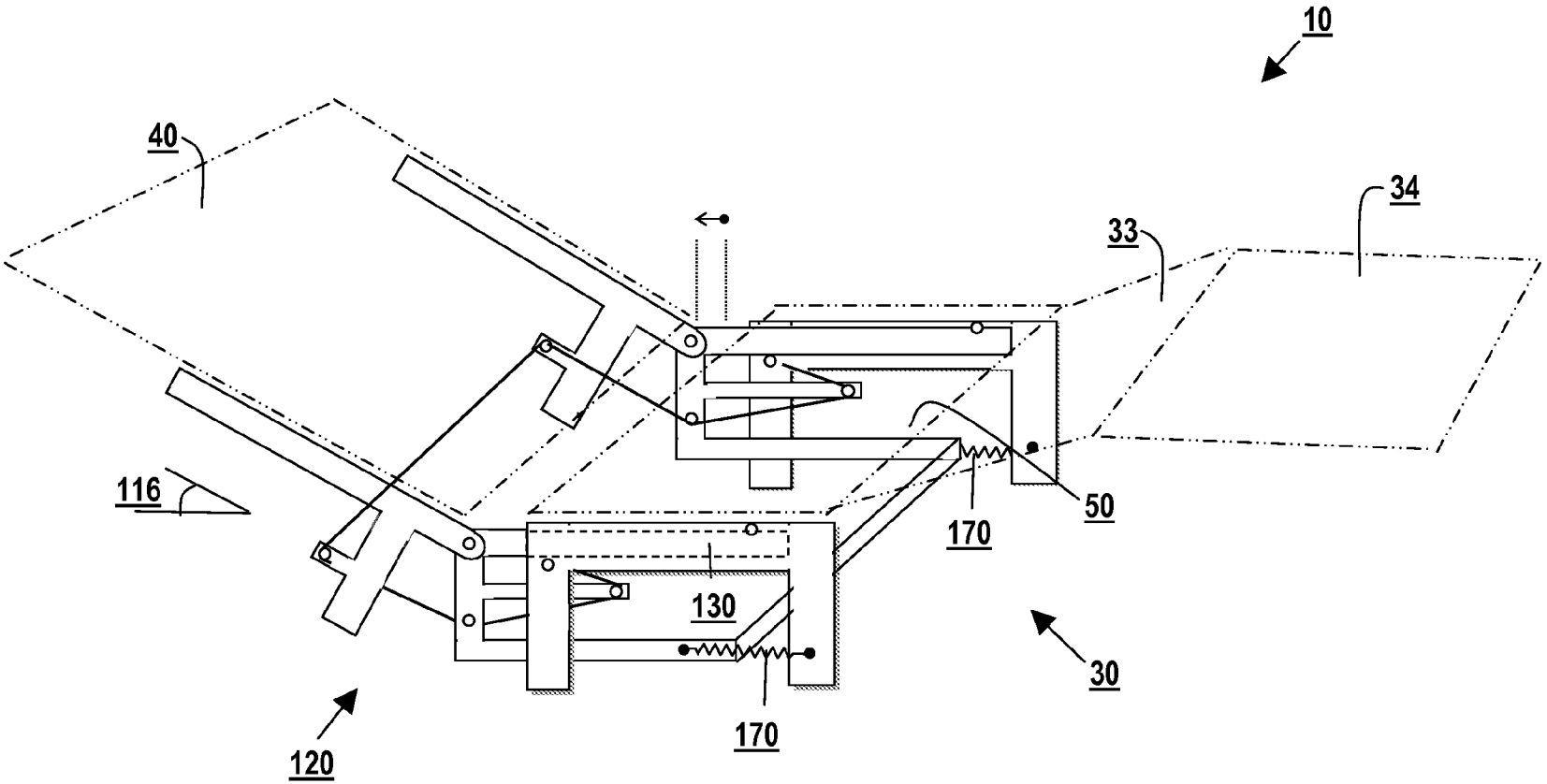
FIG. 2 illustrates the adjustable bed of FIG. 1 in a partially inclined position, with the bed's sliding torso section subframe in a partially extended position.
Figure 3:
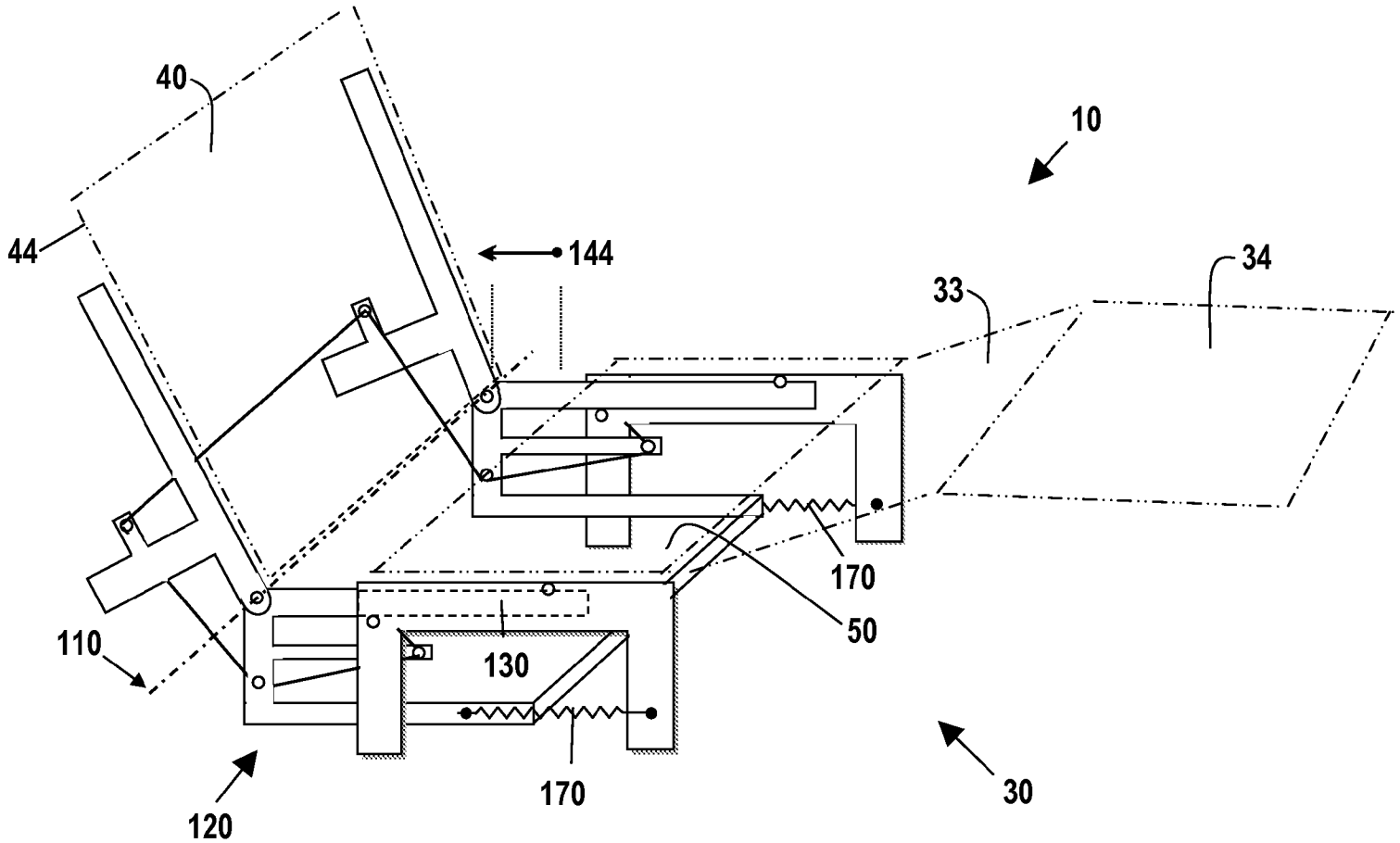
FIG. 3 illustrates the adjustable bed of FIG. 1 in a significantly inclined position.

FIGS. 1-3 illustrate a traction-cable-based embodiment of the axis-displacement mechanism 120. Each end of a long traction cable 160 is fixedly attached to opposite sides of the bed 10 in the region of the derriere-supporting section 50. The traction cable 160 is mounted along intermediate points of its length on several pulleys 165 positioned on the sliding frame and the torso-supporting section 40. Articulation of the torso-supporting section 40 toward the inclined position 44 tensions the traction cable 160, which in turn pushes the sliding bars 132, 134 from their retracted positions 142 toward their extended positions 144. Although a single long traction cable 160 is preferred, two separate traction cables 160 can replace the single long traction cable 160 depicted in FIGS. 1-3. At least one, and preferably two traction springs 170 are provided to bias the sliding bars 132, 134 toward their retracted positions 142. In this manner, the bars 132, 134 return to their retracted positions 142 as the torso-supporting section 40 articulates from the inclined position 44 back toward the substantially level position 42.

Figure 15:
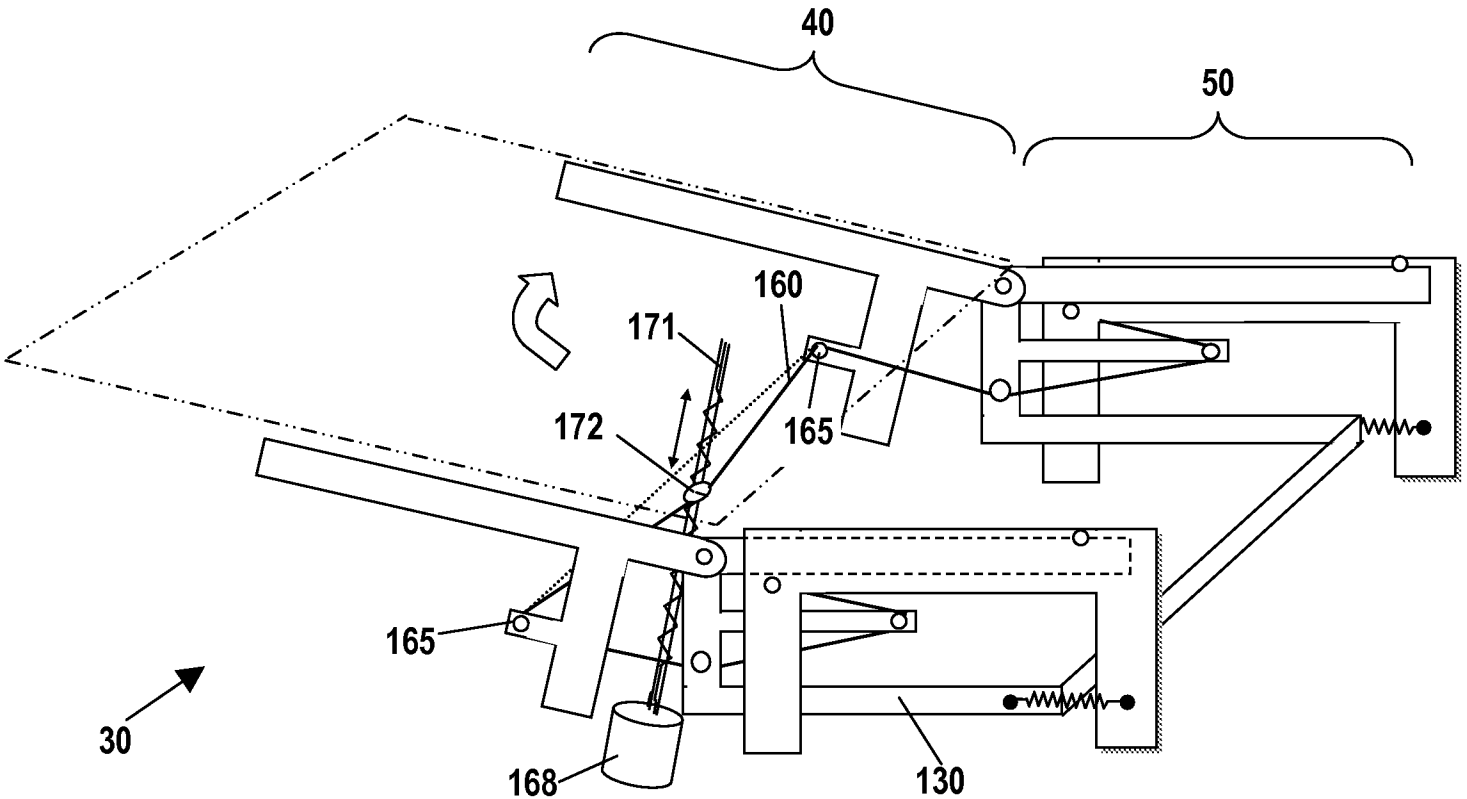
FIG. 15 illustrates the patient support structure of FIG. 7 with a cable slack adjustment mechanism.

In preferred embodiments, the axis-displacement mechanism 120 is adapted to initiate translation of the transversal axis of rotation 110 toward the head end 12 of the bed 10 when the torso-supporting section 40 reaches a preset initiation angle 116 (FIG. 2) of twenty-five degrees or more. For this purpose, a cable-slack adjustment mechanism 168 (FIG. 15) (such as a clamp or screw) is provided to regulate the length and amount of slack in the traction cable 160. More particularly, FIG. 15 illustrates a leadscrew 171 that moves a leadscrew nut 172 along the screw axis. The leadscrew nut is connected to an eyehook (not shown) through which the cable 160 is threaded between two of the pulleys 165. Movement of the leadscrew 171 controls the amount of slack by drawing the cable 160 away from or toward the segment connecting the adjacent pulleys 165. The amount of slack in the cable 160 regulates the initiation angle 116 for initiating translation of the transversal axis of rotation 110.

Figure 4:
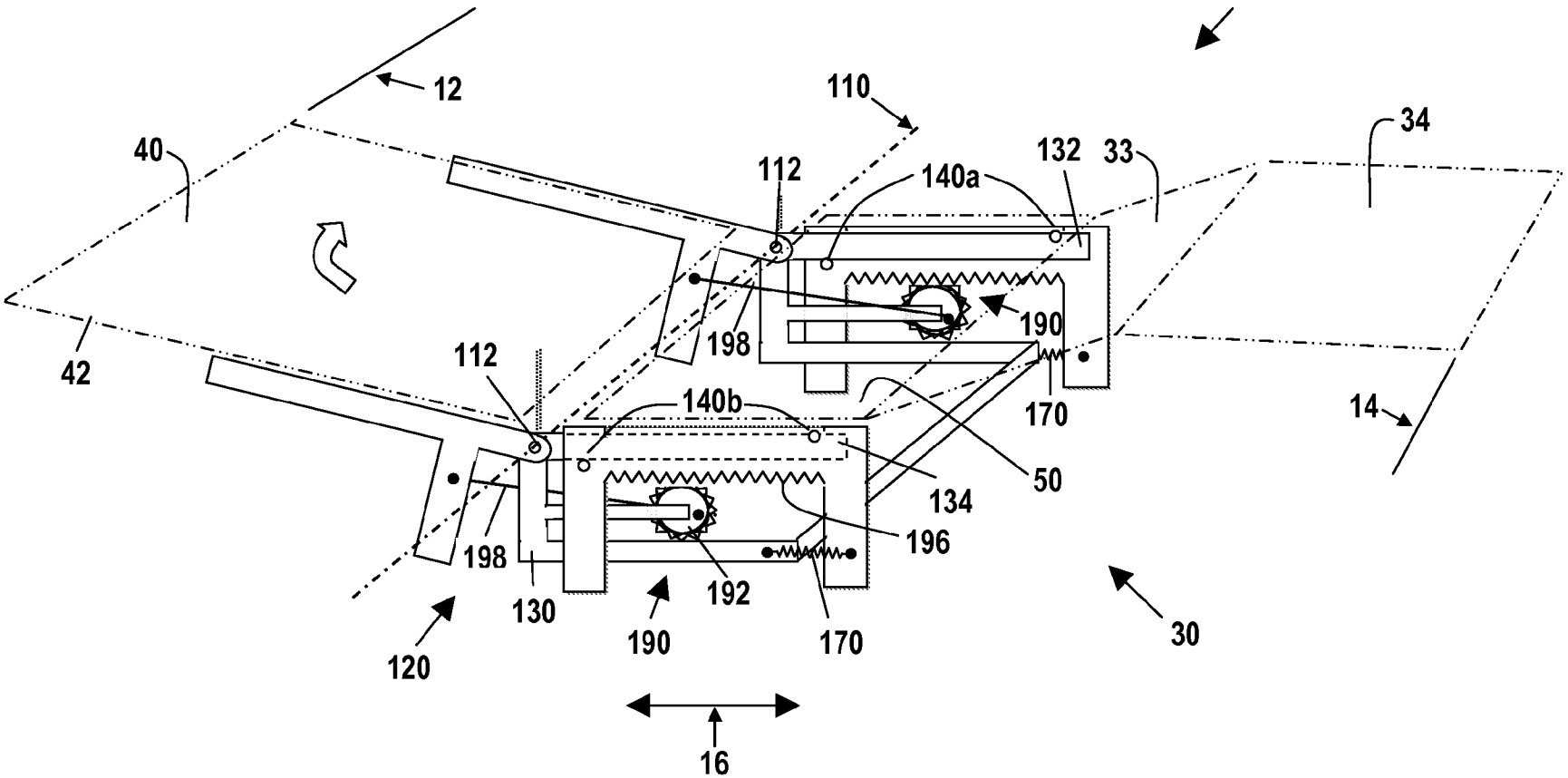
FIG. 4 illustrates an alternative embodiment of an adjustable bed having a rack-and-pinion-based sliding torso section subframe in a retracted position.
Figure 5:
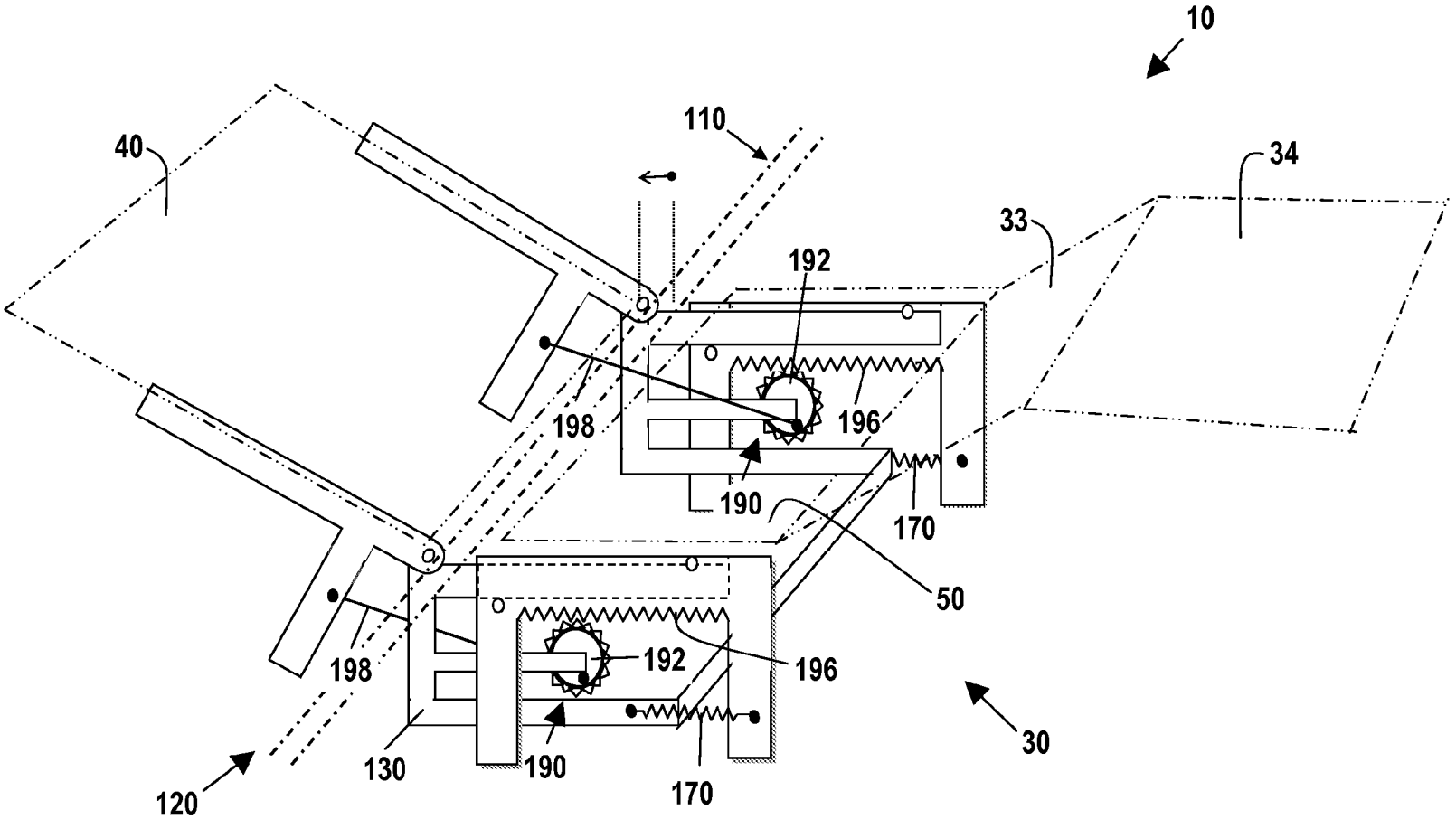
FIG. 5 illustrates the adjustable bed of FIG. 4 in a partially inclined position, with the bed's sliding torso section subframe in a partially extended position.
Figure 6:
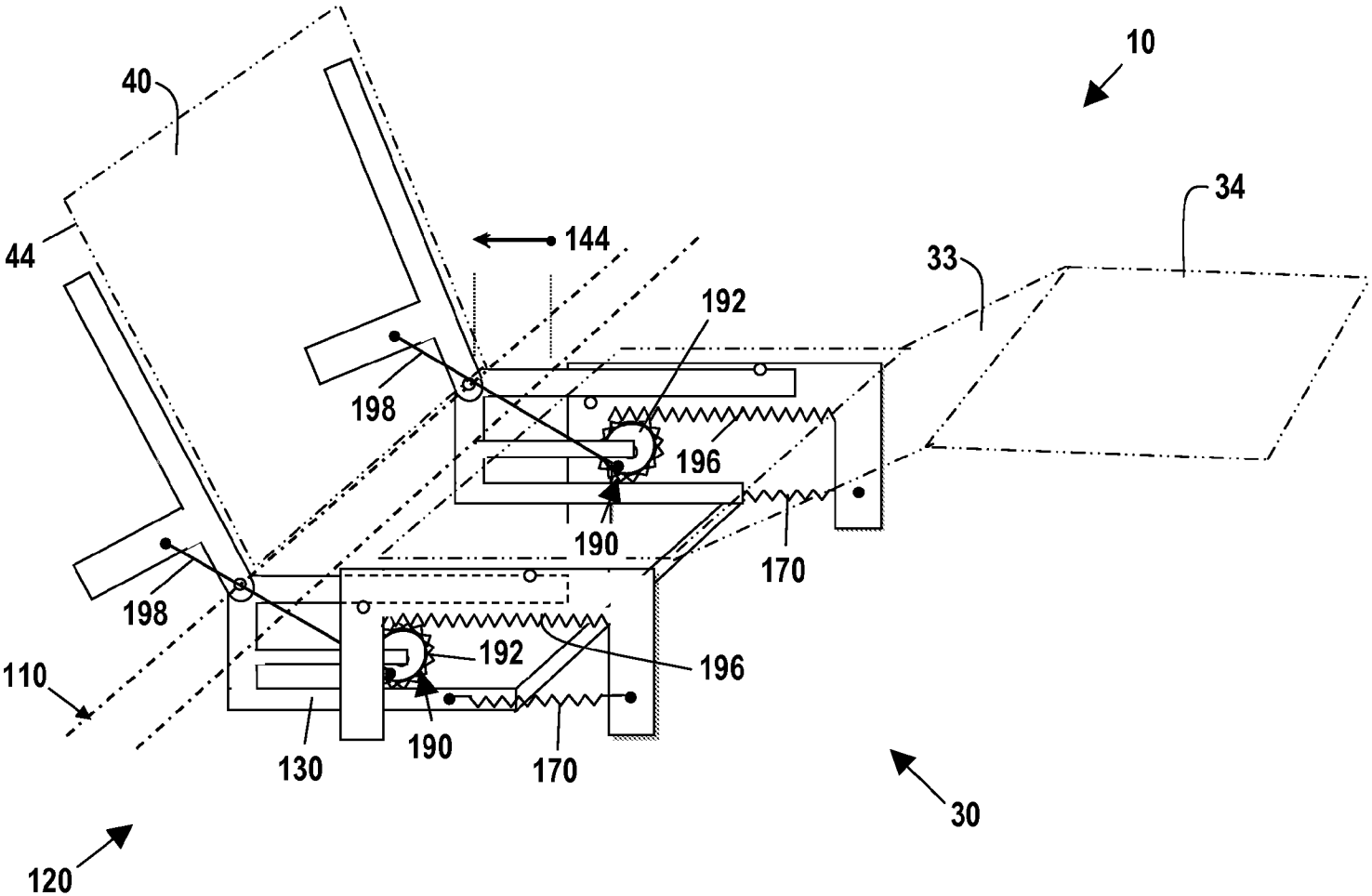
FIG. 6 illustrates the adjustable bed of FIG. 4 in a significantly inclined position.
Figure 7:
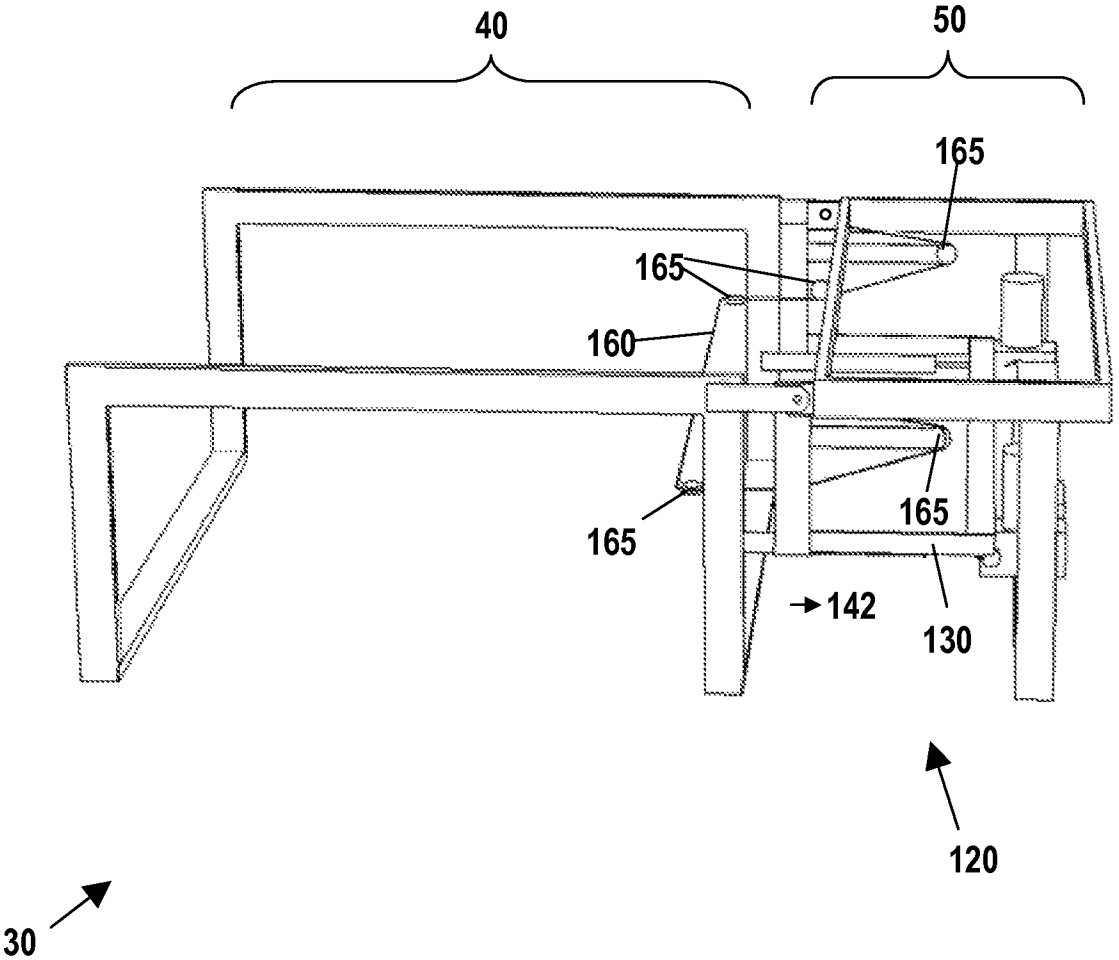
FIG. 7 illustrates a patient support structure with one embodiment of a traction-wire based sliding subframe.
Figure 8:
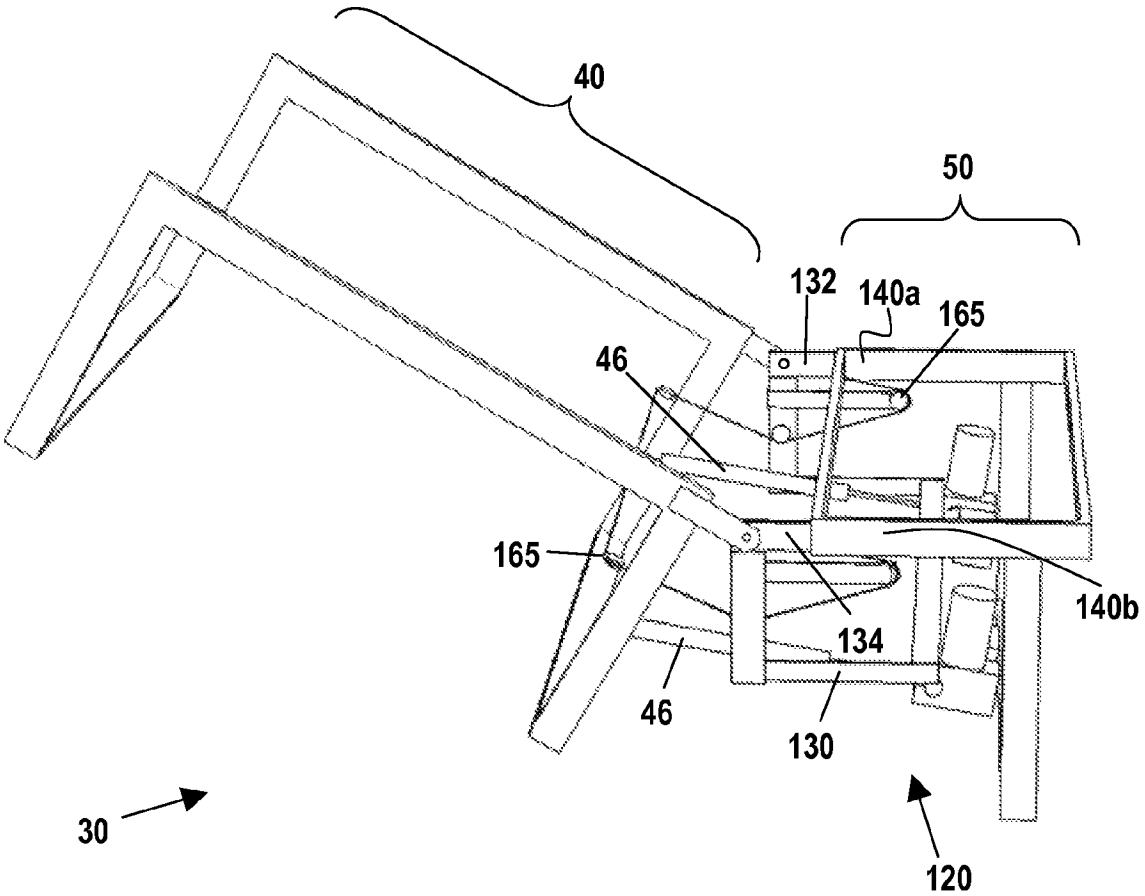
FIG. 8 illustrates the patient support structure of FIG. 7 with the torso section in a partially inclined position.
Figure 9:
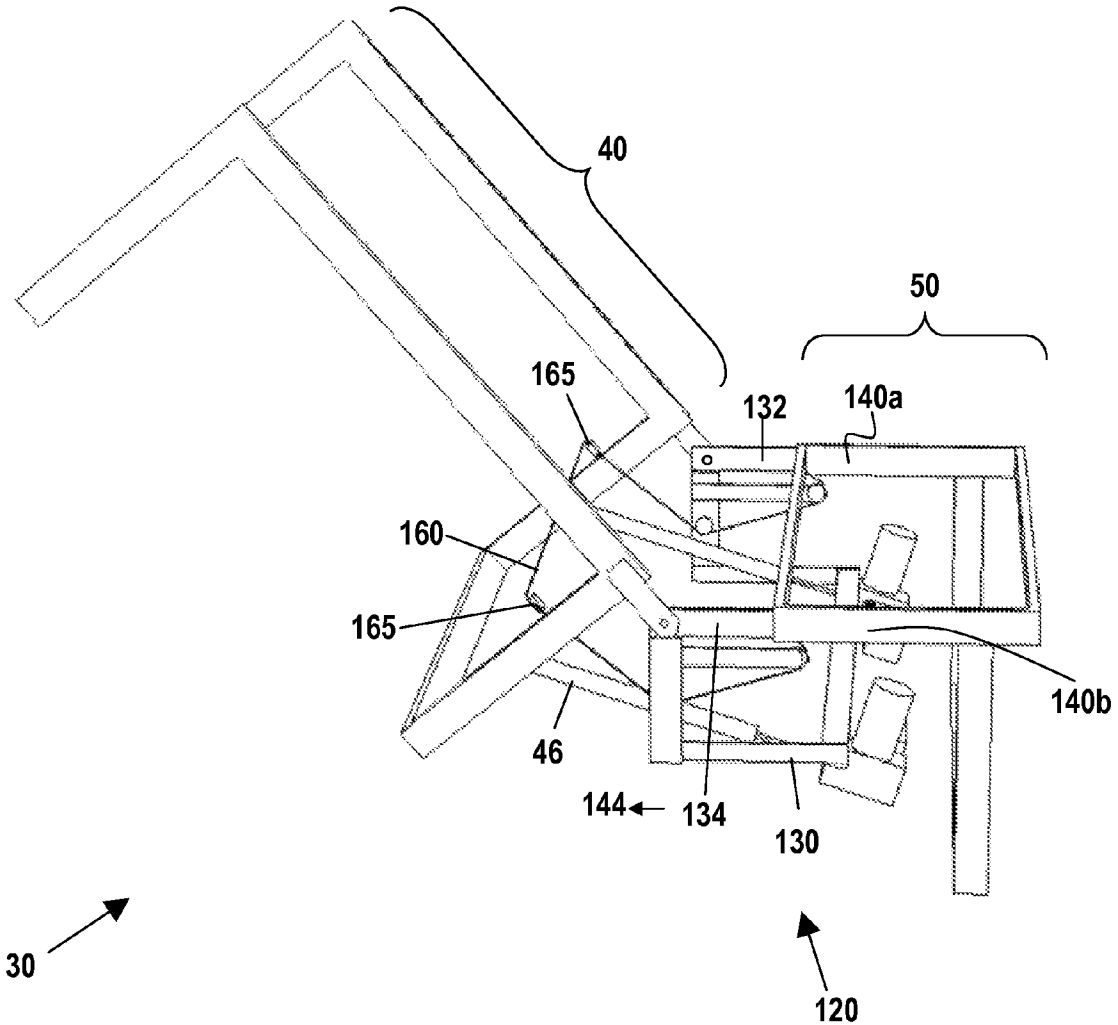
FIG. 9 is a from-the-side perspective view of the patient support structure of FIG. 7 with the torso section in a significantly inclined position.
Figure 10:
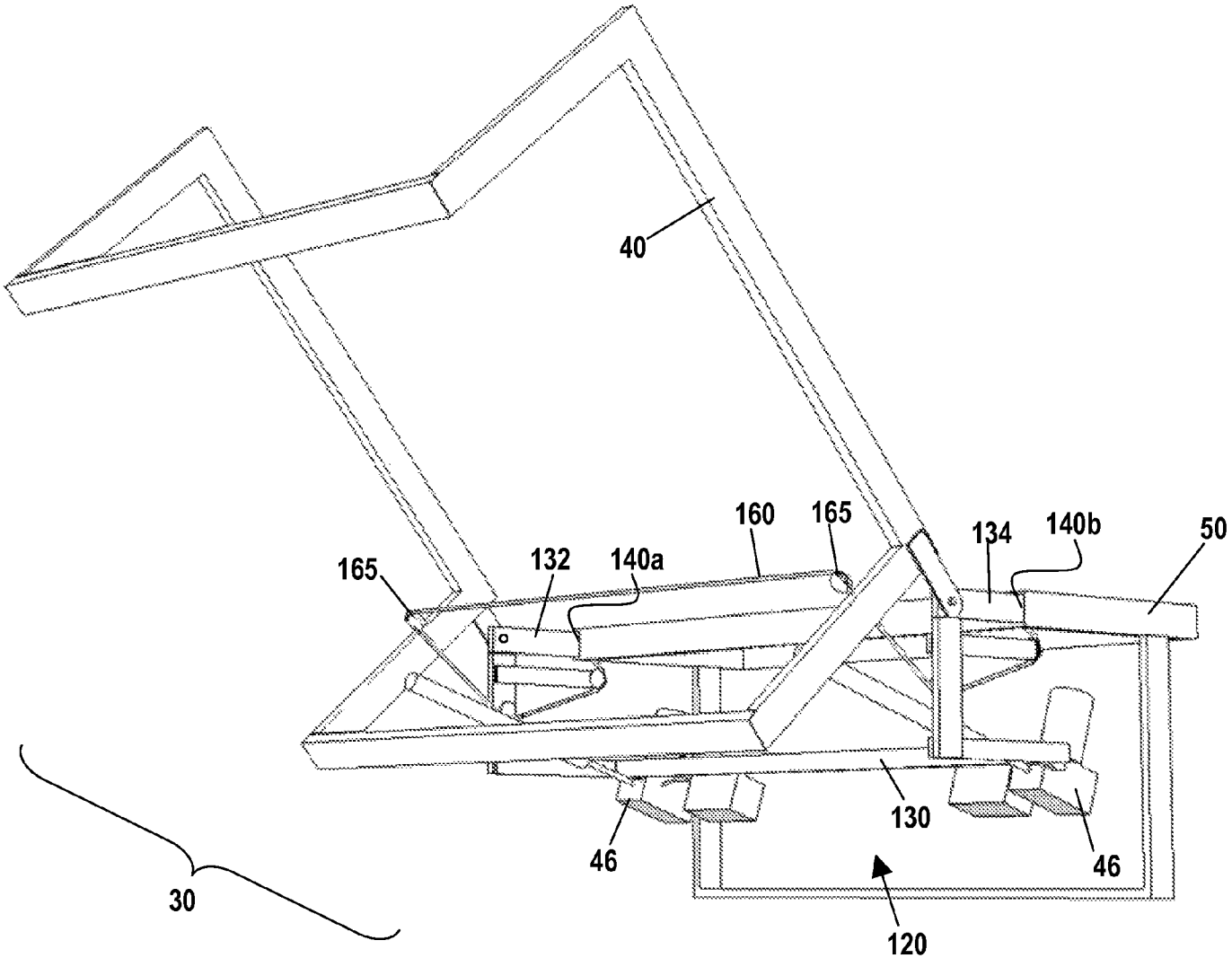
FIG. 10 illustrates the patient support structure of FIG. 9 from an oblique perspective.
Figure 11:
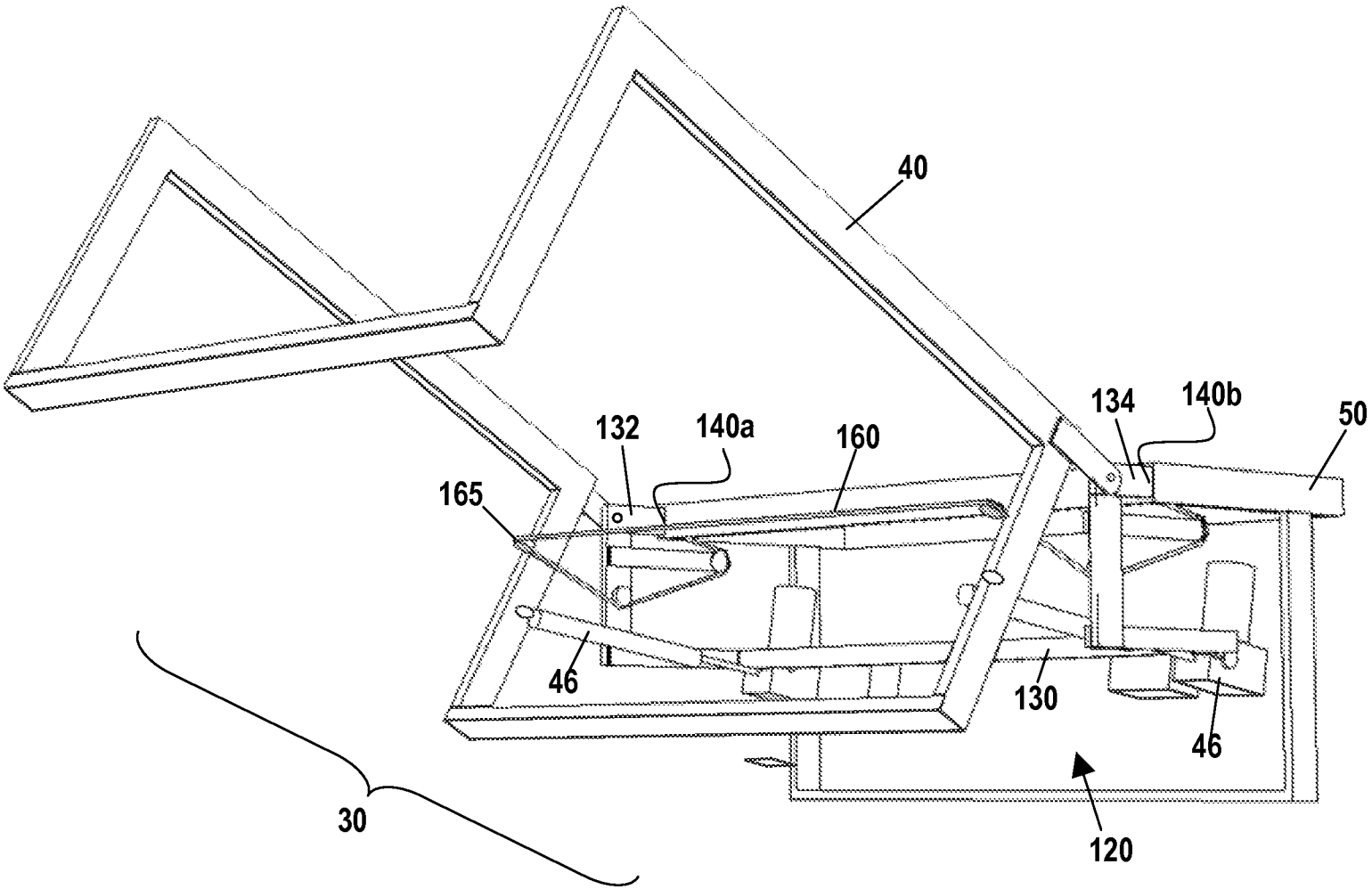
FIG. 11 illustrates the patient support structure of FIG. 8 from an oblique perspective.
Figure 12:
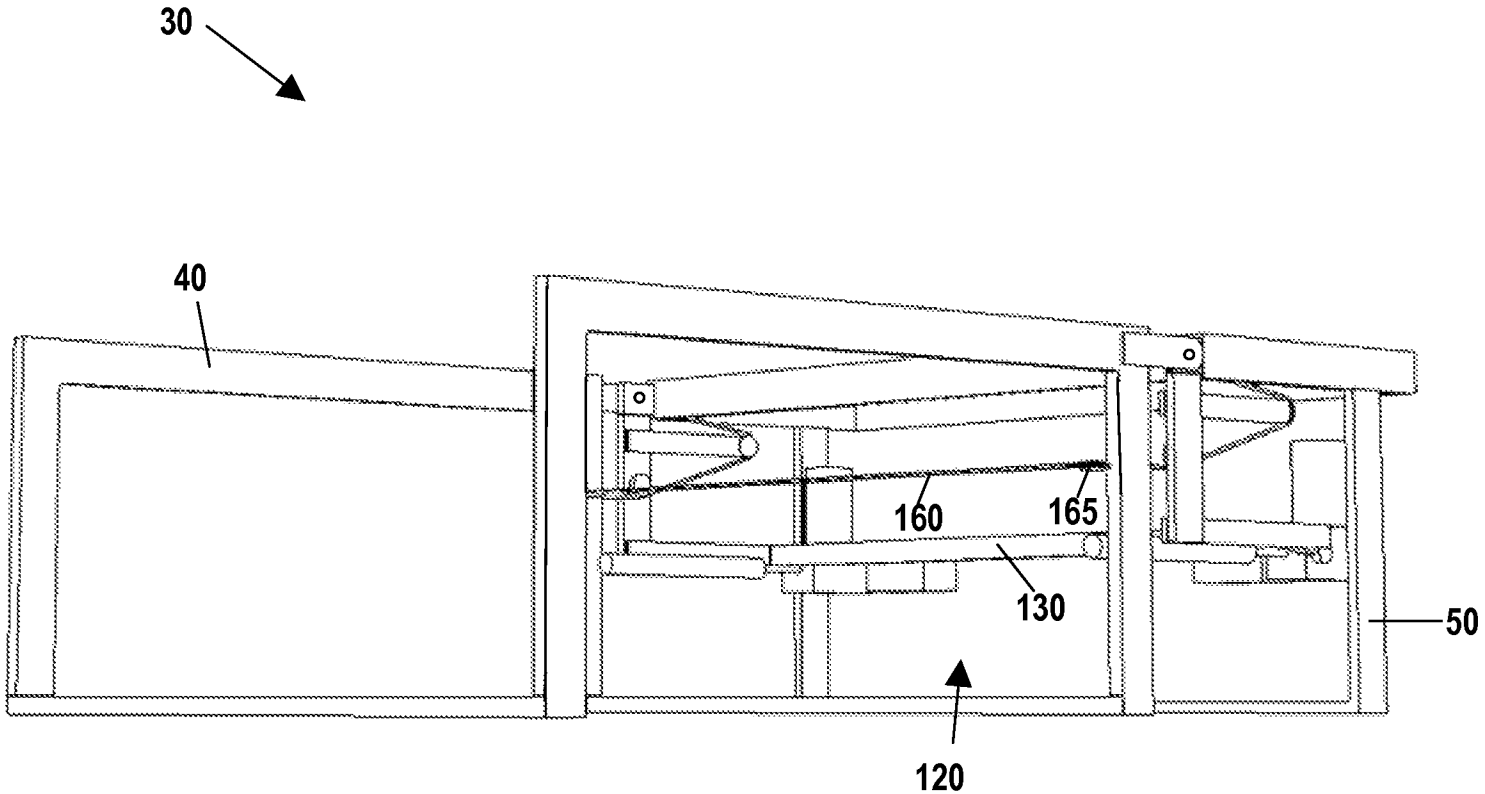
FIG. 12 illustrates the patient support structure of FIG. 7 from an oblique perspective.

FIGS. 4-6 illustrate a rack-and-pinion-based embodiment of the axis-displacement mechanism 120. In this embodiment, rack and pinion mechanisms 190 are positioned on opposite lateral sides of the derriere-supporting section 50. Each rack and pinion mechanism 190 comprises a gearwheel 192 mounted on the sliding subframe 130 that engages teeth 196 on the derriere-supporting section 50. Sliding arms 132 and 134 of the sliding subframe 130 are, as in FIGS. 1-3, adapted to move between retracted and extended positions within guides 140*a*, 140*b* mounted on the derriere-supporting section 50.

Figure 16:
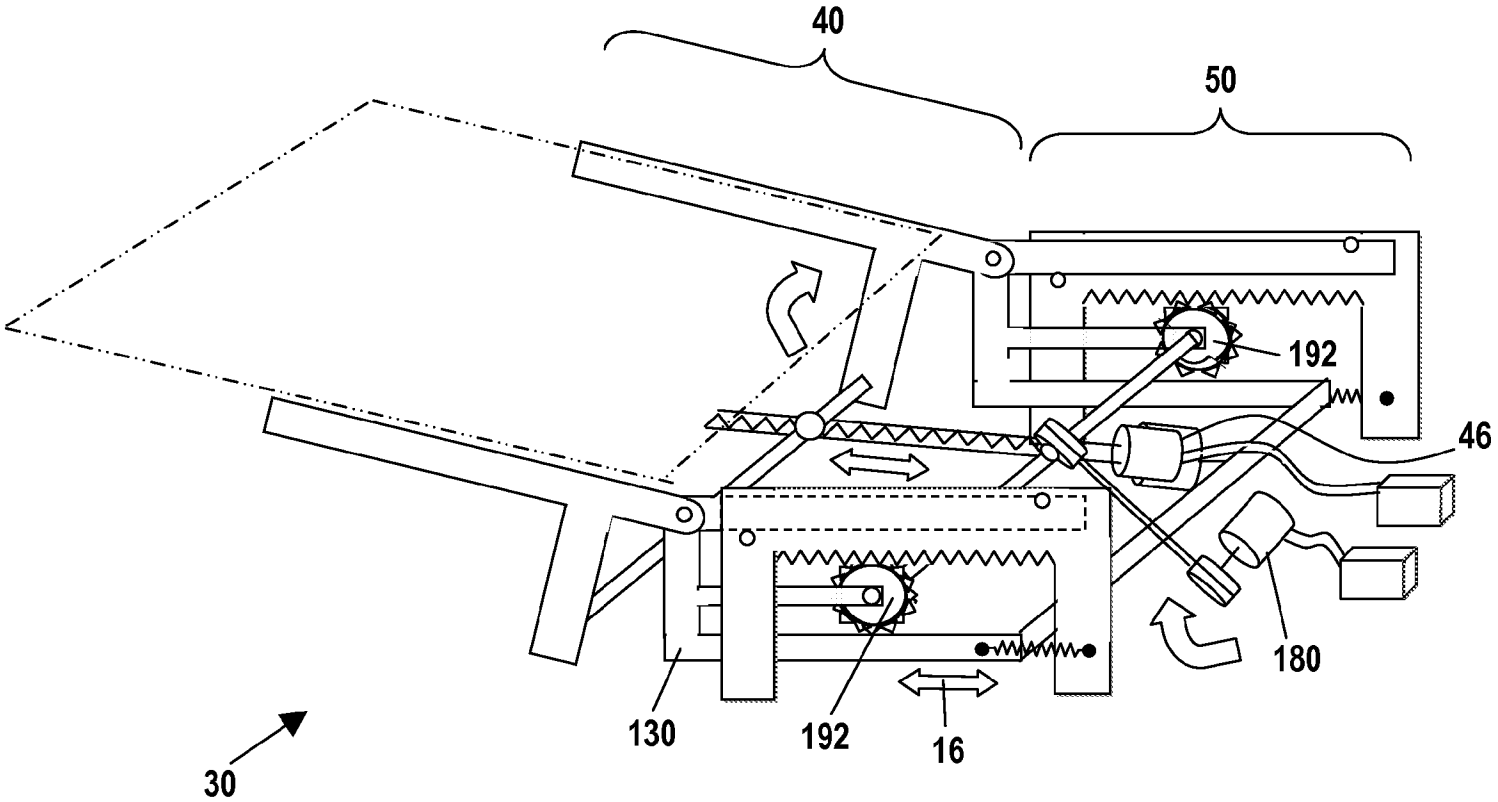
FIG. 16 illustrates a patient support structure having a rack-and-pinion-based sliding torso section subframe with a motorized actuator for driving the gearwheels.

In a typical embodiment, one or more electrically-powered mechanical actuators 46 (FIGS. 8, 16) will articulate the torso-supporting section 40 between the level and inclined positions 42 and 44. In FIGS. 1-3, this machine-powered articulation in turn causes translation of the sliding subframe 130 and displacement of the axis of rotation 110 without the use of any additional mechanical actuators. Likewise, in FIGS. 4-6, this machine-powered articulation causes the gearwheels 192, which are linked to the torso-supporting section 40 via linkages 198, to rotate, which in turn causes translation of the sliding subframe 130 and displacement of the axis of rotation 110 without the use of any additional mechanical actuators. FIG. 16 depicts an alternative embodiment. Here, the displacement of the axis of rotation 110 would be effected by one or more additional motorized actuators 180 (FIG. 16) mounted to the adjustable bed 10 to drive the gearwheels 192, which in turn drives the sliding frame 130 between its retracted and extended positions 142 and 144.

Figure 13:
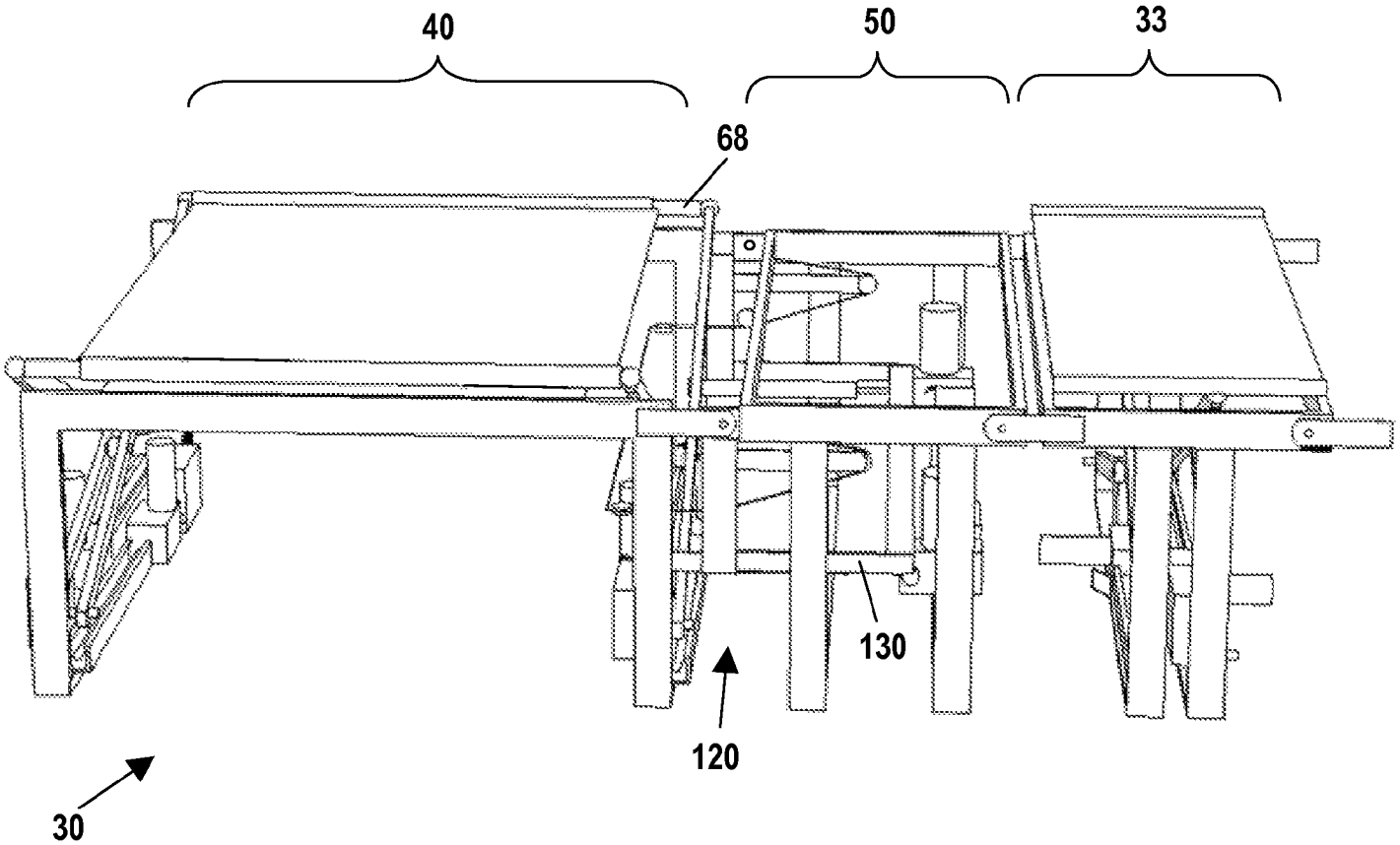
FIG. 13 illustrates another, more sophisticated embodiment of a patient support structure with a sliding torso section subframe.
Figure 14:
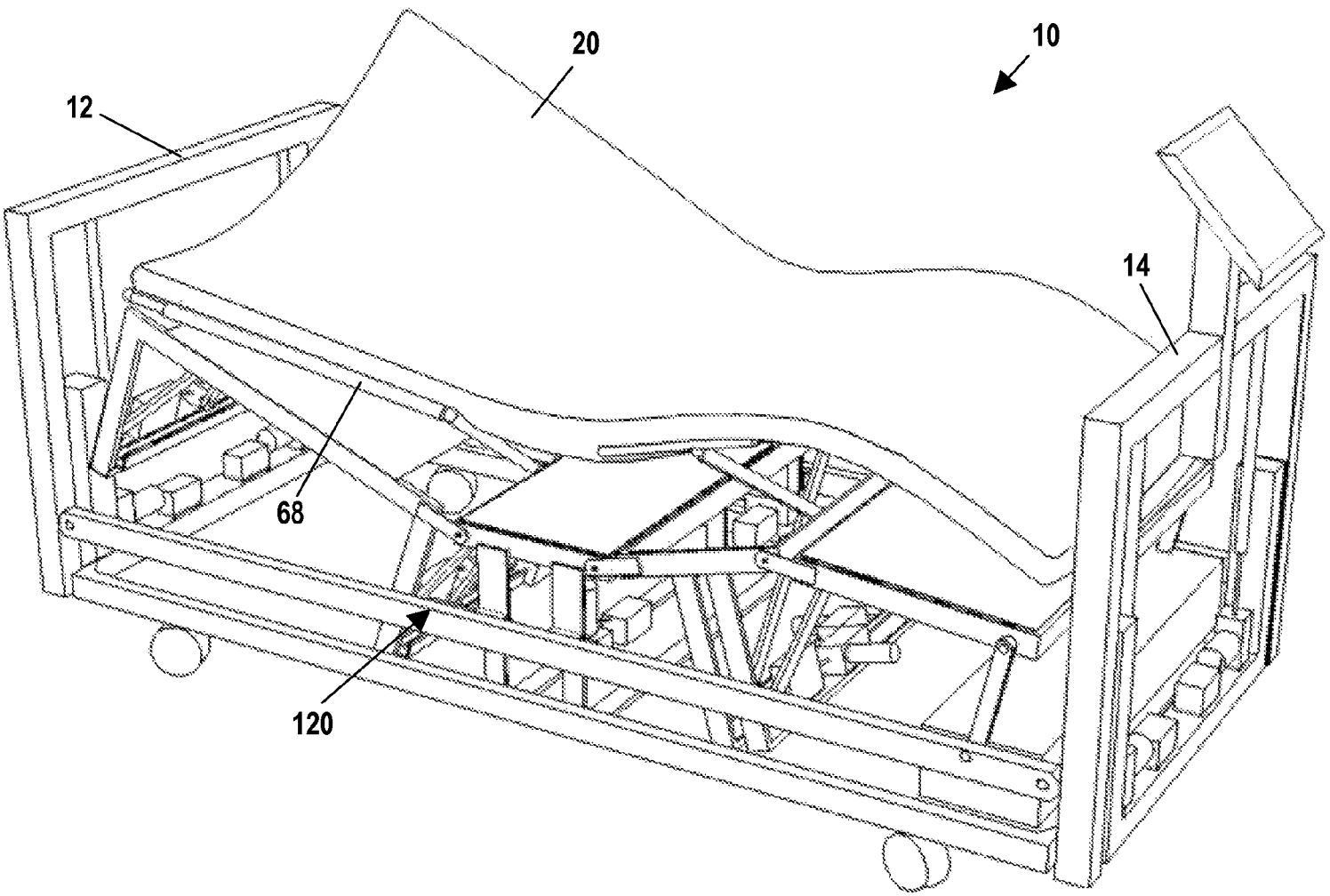
FIG. 14 illustrates an adjustable bed with a sliding torso section subframe.

FIGS. 13 and 14 illustrate an embodiment of the sliding subframe mechanism incorporated into a mechanical bed of the type described and depicted in application Ser. No. 11/869,696 entitled "Bed with Adjustable Patient Support Framework" filed on Oct. 9, 2007, which application is herein incorporated by reference. In particular, an adjustable bed 10 is depicted having a patient support surface 20, a torso-supporting section 40 with a torso support litter 68, and an axis-displacement mechanism 120 for the torso-supporting section 40. But it should be understood that the invention is not so limited, unless explicitly so limited by the claims, and can be incorporated in a large variety of hospital and non-hospital beds.

This invention also incorporates herein by reference, the following patent applications: App. No. 60/979,836 entitled "Patient Support Surface with Modulating Hip-Cradling Perimeter" filed on Oct. 14, 2007; App. No. 60/979,837 entitled "Adjustable Bed with Sacral Pressure Relieve Function" filed on Oct. 14, 2007; and App. No. 60/979,838 entitled "Modulating Support Surface to Aid Patient Entry and Exit" filed on Oct. 14, 2007.

Having thus described exemplary embodiments of the present invention, it should be noted that the disclosures contained in FIGS. 1-16 are exemplary only, and that various other alternatives, adaptations, and modifications may be made within the scope of the present invention. Accordingly, the present invention is not limited to the specific embodiments illustrated herein, but is limited only by the following claims.

We claim:

1. An adjustable bed (10) comprising:

a head end (12) and a foot end (14);

a patient support surface (20);

a patient support structure (30) for supporting the patient support surface (20);

the patient support structure (30) comprising a plurality of adjacent lateral patient support sections (40, 50), including a first support section (40) adjacent to second support section (50);

the first support section (40) being adapted to support the torso of a patient lying on the patient support surface (20);

the first support section (40) being adapted to articulate about a transversal axis of rotation (110) between a substantially level position (42) and an inclined position (44);

a sliding subframe (130) mounted on a guide mechanism (140*a*, 140*b*) adjacent the second support section (50) for movement, with respect to the second support section (50), between retracted and extended positions (142, 144) along the longitudinal dimension (16) of the bed (10); and the sliding subframe (130) being adapted to translate the transversal axis of rotation (110) toward the head end (12) of the bed (10) and away from second support section (50) as the first support section (40) articulates from the substantially level position (42) toward the inclined position (44) such that the transversal axis of rotation is spaced from the second support section, and to translate the transversal axis of rotation (110) toward the foot end (14) of the bed (10) as the first support section (40) articulates from the inclined position (44) toward the substantially level position (42).

2. The adjustable bed (10) of claim 1, further comprising a mechanical actuator (46) adapted to articulate the first support section (40) between its substantially level and inclined positions (42, 44).

3. The adjustable bed (10) of claim 2, wherein movement of the sliding subframe (130) is effected by articulation of first support section (40) without the use of any additional mechanical actuators.

4. The adjustable bed (10) of claim 2, wherein the mechanical actuator (46) is mounted below the guide mechanism (140*a*, 140*b*) and is oriented to exert force in an essentially only horizontal longitudinal direction when the first support section (40) is in its substantially level position (42).

5. The adjustable bed (10) of claim 4, wherein the mechanical actuator (46) gradually pivots from a horizontal longitudinal orientation to a tilted longitudinal orientation as it articulates the first support section (40) from its substantially level position (42) to its inclined positions (44).

6. The adjustable bed (10) of claim 2, wherein the mechanical actuator (46) is mounted to the sliding subframe (130) and translates with the sliding subframe (130) as it (130) moves between retracted and extended positions (142, 144).

7. The adjustable bed (10) of claim 2, wherein the mechanical actuator (46) co-acts with a lever mounted to the first support section (40) and positioned below the transversal axis of rotation (110) to articulate the first support section (40) between the substantially level and inclined positions (42, 44).

8. The adjustable bed (10) of claim 1, wherein the sliding subframe (130) is adapted to initiate translation of the transversal axis of rotation (110) toward the head end (12) of the bed (10) after the first support section (40) reaches a preset initiation angle (116) of at least 25 degrees.

9. The adjustable bed (10) of claim 1, wherein the sliding subframe (130) comprises bars (132, 134) guidingly mounted via a set of wheels (140*a*, 140*b*) for linear movement on the second support section (50), between retracted and extended positions (142, 144), wherein the set of wheels (140*a*, 140*b*) comprises at least first and second pairs of longitudinally-displaced wheels.

10. The adjustable bed (10) of claim 9, further characterized in that one or more traction cables (160) are operable to cause the one or more bars (132, 134) to move from their retracted positions (142) into their extended positions (144) as the first support section (40) articulates from the substantially level position (42) toward the inclined position (44).

11. The adjustable bed (10) of claim 9, wherein the sliding subframe (130) is configured to fully support the first support section (40) in the inclined position (44).

12. An adjustable bed (10) comprising:

a head end (12) and a foot end (14);

a patient support surface (20);

a patient support structure (30) for supporting the patient support surface (20);

the patient support structure (30) comprising a plurality of adjacent lateral patient support sections (40, 50), including a first support section (40) adjacent to second support section (50);

the first support section (40) being adapted to support the torso of a patient lying on the patient support surface (20);

the first support section (40) being adapted to articulate about a transversal axis of rotation (110) between a substantially level position (42) and an inclined position (44); and an axis-displacement mechanism (120) mounted on the second support section (50), the axis-displacement mechanism (120) being adapted to translate the transversal axis of rotation (110) toward the head end (12) of the bed (10) as the first support section (40) articulates from the substantially level position (42) toward the inclined position (44) and to translate the transversal axis of rotation (110) toward the foot end (14) of the bed (10) as the first support section (40) articulates from the inclined position (44) toward the substantially level position (42);

wherein the axis-displacement mechanism (120) is adapted to initiate translation of the transversal axis of rotation (110) toward the head end (12) of the bed (10) when the first support section (40) reaches a preset initiation angle (116) of at least 25 degrees.

13. The adjustable bed (10) of claim 12, wherein the axis-displacement mechanism (120) comprises:

one or more bars (132, 134) hingedly connected to the first support section (40), the one or more bars (132, 134) being adapted to move between retracted and extended positions (142, 144) within a guide (140*a*, 140*b*) mounted on the second support section (50); and one or more traction cables (160) operable to cause the one or more bars (132, 134) to move from their retracted positions (142) into their extended positions (144) as the first support section (40) articulates from the substantially level position (42) toward the inclined position (44);

wherein the traction cables (160) are each mounted on the first and second support sections (40, 50) and on one or more pulleys (165), such that articulation of the first support section (40) beyond an initiation angle (116) tensions the traction cables (160), pushing the one or more bars (132, 134) into their extended positions (144).

14. The adjustable bed (10) of claim 13, further comprising a cable slack adjustment mechanism (168) operable to regulate the amount of slack in the traction cables (160) when the first support section (40) is in its substantially level position (42), the amount of slack defining an initiation angle (116) for initiating translation of the transversal axis of rotation (110).

15. The adjustable bed (10) of claim 12, wherein the axis-displacement mechanism (120) further comprises a traction spring (170) operable to cause the axis-displacement mechanism (120) to return from an extended position (144) to a retracted position (142) as the first support section (40) articulates from the inclined position (44) toward the substantially level position (42).

16. An articulatable bed (10) with a longitudinal dimension (16) extending between head and foot ends (12, 14) of the bed (10), the bed (10) comprising:

a derriere-supporting section (50) for supporting the derriere of a patient;

an articulating torso-supporting section (40) adjacent the derriere-supporting section (50);

a transversal axis of rotation (110) about which the articulating torso-supporting section (50) rotates;

a sliding subframe (130) rotatably joined to the articulating torso-support section (40) at the transversal axis of rotation (110);

a guide mechanism (140*a*, 140*b*) mounted adjacent the derriere-supporting section (50) that is adapted to guide the sliding subframe (130) between retracted and extended positions (142, 144), with respect to the second support section (50), along the longitudinal dimension (16) of the bed (10), thereby translating the transversal axis of rotation (110) of the articulating torso-supporting section (40) along the longitudinal dimension (16) such that the transversal axis of rotation is spaced away from the derriere-supporting section (50);

wherein articulation of the torso-supporting section (40) from a substantially level position (42) toward a significantly inclined position (44) causes the transversal axis of rotation (110) to slide back, along the longitudinal dimension (16), away from the derriere-supporting section (50); and articulation of the torso-supporting section (40) from a significantly inclined position (44) to a substantially level position (42) causes the transversal axis of rotation (110) to slide forward, along the longitudinal dimension (16), toward the derriere-supporting section (50).

17. The articulatable bed (10) of claim 16, further comprising a mechanical actuator (46) adapted to articulate the torso-supporting section (40) between its substantially level and inclined positions (42, 44).

18. The articulatable bed (10) of claim 17, wherein translation of the sliding subframe (130) between retracted and extended positions (142, 144) is effected by articulation of the torso-supporting section (40) without the use of any additional mechanical actuators.

19. The adjustable bed (10) of claim 15, wherein the mechanical actuator (46) is mounted below the guide mechanism (140*a*, 140*b*) and is oriented to exert force in an essentially only horizontal longitudinal direction when the torso-supporting section (40) is in its substantially level position (42).

20. The adjustable bed (10) of claim 19, wherein the mechanical actuator (46) gradually pivots from a horizontal longitudinal orientation to a tilted longitudinal orientation as it articulates the torso-supporting section (40) from its substantially level position (42) to its inclined positions (44).

21. The adjustable bed (10) of claim 17, wherein the mechanical actuator (46) is mounted to the sliding subframe (130) and translates with the sliding subframe (130) as it (130) moves between retracted and extended positions (142, 144).

* * * * *